US009745715B2

(12) United States Patent
Horton et al.

(10) Patent No.: US 9,745,715 B2
(45) Date of Patent: Aug. 29, 2017

(54) DREDGE WITH WATER-JET CUTTERHEAD

(71) Applicant: Liquid Waste Technology, LLC, New Richmond, WI (US)

(72) Inventors: Ryan Patrick Horton, Leawood, KS (US); David Meyer, Hudson, WI (US); Robert M. Schettle, Hudson, WI (US); Brian John Lindahl, Somerset, WI (US)

(73) Assignee: Liquid Waste Technology, LLC, New Richmond, WI (US)

( * ) Notice: Subject to any disclaimer, the term of this patent is extended or adjusted under 35 U.S.C. 154(b) by 0 days.

(21) Appl. No.: 15/046,312

(22) Filed: Feb. 17, 2016

(65) Prior Publication Data

US 2016/0244942 A1 Aug. 25, 2016

Related U.S. Application Data

(60) Provisional application No. 62/118,579, filed on Feb. 20, 2015.

(51) Int. Cl.
*E02F 3/92* (2006.01)
*E02F 3/88* (2006.01)

(52) U.S. Cl.
CPC ..... *E02F 3/9262* (2013.01); *E02F 3/8841* (2013.01); *E02F 3/9218* (2013.01); *E02F 3/9237* (2013.01); *E02F 3/9281* (2013.01)

(58) Field of Classification Search
CPC ..... E02F 3/9218; E02F 3/9262; E02F 3/925
See application file for complete search history.

(56) References Cited

U.S. PATENT DOCUMENTS 532,183 A * 1/1895 Pike ..... E02F 3/9262 209/454
3,412,862 A * 11/1968 Chaplin ..... E02B 3/023 15/1.7
3,971,148 A * 7/1976 Deal ..... E02F 3/9293 198/497
4,628,623 A * 12/1986 Deal ..... E02F 3/9237 37/195
5,970,635 A * 10/1999 Wilmoth ..... E02B 3/023 37/323
7,395,618 B2 * 7/2008 Jacobsen ..... E02F 3/9262 37/313

FOREIGN PATENT DOCUMENTS

DE GB 191127153 A * 5/1912 ..... E02F 3/9262
GB WO 8803197 A1 * 5/1988 ..... E02F 3/188

* cited by examiner

*Primary Examiner* — Matthew D Troutman
(74) *Attorney, Agent, or Firm* — Hovey Williams LLP

(57) ABSTRACT

A cutterhead for dredging a body of water. The cutterhead comprising a shroud including a top wall, a bottom wall, and two sidewalls each extending between the top and bottom walls. The cutterhead additionally comprises a rotatable cutterbar at least partially received within an interior space presented by the shroud, a first water-jet bar extending along a portion of the top wall of the shroud, and a second water-jet bar extending along at least a portion of one of the two sidewalls. The cutterbar and the water-jet bars are configured to generate a slurry of fluidized material from the water-bed.

17 Claims, 5 Drawing Sheets

DREDGE WITH WATER-JET CUTTERHEAD

RELATED APPLICATION

This non-provisional patent application claims priority to U.S. Provisional Patent Application Ser. No. 62/118,579, entitled "DREDGE WITH WATER-JET CUTTERHEAD," filed on Feb. 20, 2015. The entirety of the above-identified provisional patent application is incorporated by reference into this non-provisional patent application.

FIELD OF THE INVENTION

The invention broadly concerns a cutterhead for a dredge and an associated method for dredging material from a water-bed, such as a riverbed, a seabed, or the like. More particularly, the cutterhead hereof provides a water-jet action capable of loosening water-bed material, such that the material can be efficiently removed from the water-bed.

BACKGROUND

Dredges are commonly used to remove sediments from the bottom areas of various types of bodies of water. Such bottom areas are herein described as a "water-beds." For example, dredges may remove silt from a riverbed, sand from a seabed, or other materials from other types of water-beds. Dredges typically comprise a hull which floats on top of the water. A boom with a cutterhead can be pivotally attached to the hull. As such, when the cutterhead is in a lowered position, i.e., with the cutterhead positioned adjacent to the water-bed, the cutterhead can be operated in combination with a pump to stir up and remove a slurry of water-bed material from the body of water.

During operation, the cutterhead is required to output a significant amount of force to stir up and agitate the material on the water-bed so as to create a slurry that can be pumped away. Traditional dredges have implemented cutterheads that include a rotatable cutterbar within a shroud. With the cutterhead positioned adjacent to the water-bed, the rotatable cutterbar is generally configured to grind into the water-bed and churn water-bed material, such that the water-bed material can be fluidized into a slurry capable of being pumped away to a barge or to an adjacent shore. Nevertheless, in circumstances in which the water-bed material is hard or solid, the cutterhead may not have sufficient power to sufficiently fluidize the water-bed material. Furthermore, even if the rotatable cutterbar is capable of at least partially fluidizing the water-bed material, the shroud of the cutterhead may make frictional contact with the water-bed, thereby restricting the cutterhead's travel about the water-bed and inhibiting dredging operations.

SUMMARY

The present invention solves the above-described problems and provides a distinct advance in the art of dredging.

One embodiment of the present invention broadly includes a cutterhead for dredging a body of water. The cutterhead comprises a shroud including a top wall, a bottom wall, and two sidewalls each extending between the top and bottom walls. The cutterhead additionally comprises a rotatable cutterbar at least partially received within an interior space presented by the shroud, a first water-jet bar extending along a portion of the top wall of the shroud, and a second water-jet bar extending along at least a portion of one of the two sidewalls. The cutterbar and the water-jet bars are configured to generate a slurry of fluidized material from the water-bed.

Another embodiment of the present invention includes a dredge-type watercraft comprising a hull, a boom having first and second ends, with the first end being pivotably secured to the hull, and a cutterhead secured to the second end of the boom. The cutterhead includes a shroud including a top wall, a bottom wall, and two sidewalls each extending between the top and bottom walls. The cutterhead additionally includes a rotatable cutterbar at least partially received within an interior space presented by the shroud. The cutterhead further includes a first water-jet bar extending along a portion of the top wall of the shroud, and a second water-jet bar extending along at least a portion of one of the two sidewalls.

A further embodiment of the present invention includes a method for dredging material from a water-bed. The method comprises an initial step of lowering a boom from a watercraft. The boom includes a cutterhead for fluidizing the material from the water-bed, with the cutterhead including a shroud comprised of a top wall, a bottom wall, and two sidewalls each extending between the top and bottom walls. The cutterhead further includes water-jet nozzles extending along at least a portion of each of the top wall and the two sidewalls. During the lowering step, the boom is lowered such that the cutterhead is adjacent to the water-bed. The method includes an additional step of causing the water-jet nozzles to emit jets of water so as to fluidize material from the water-bed. The method includes a further step of removing the fluidized material from near the water-bed and directing it to a remote collecting location.

This summary is provided to introduce a selection of concepts in a simplified form that are further described below in the detailed description below. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present technology are described in detail below with reference to the attached drawing figures, wherein.

Figure 1:
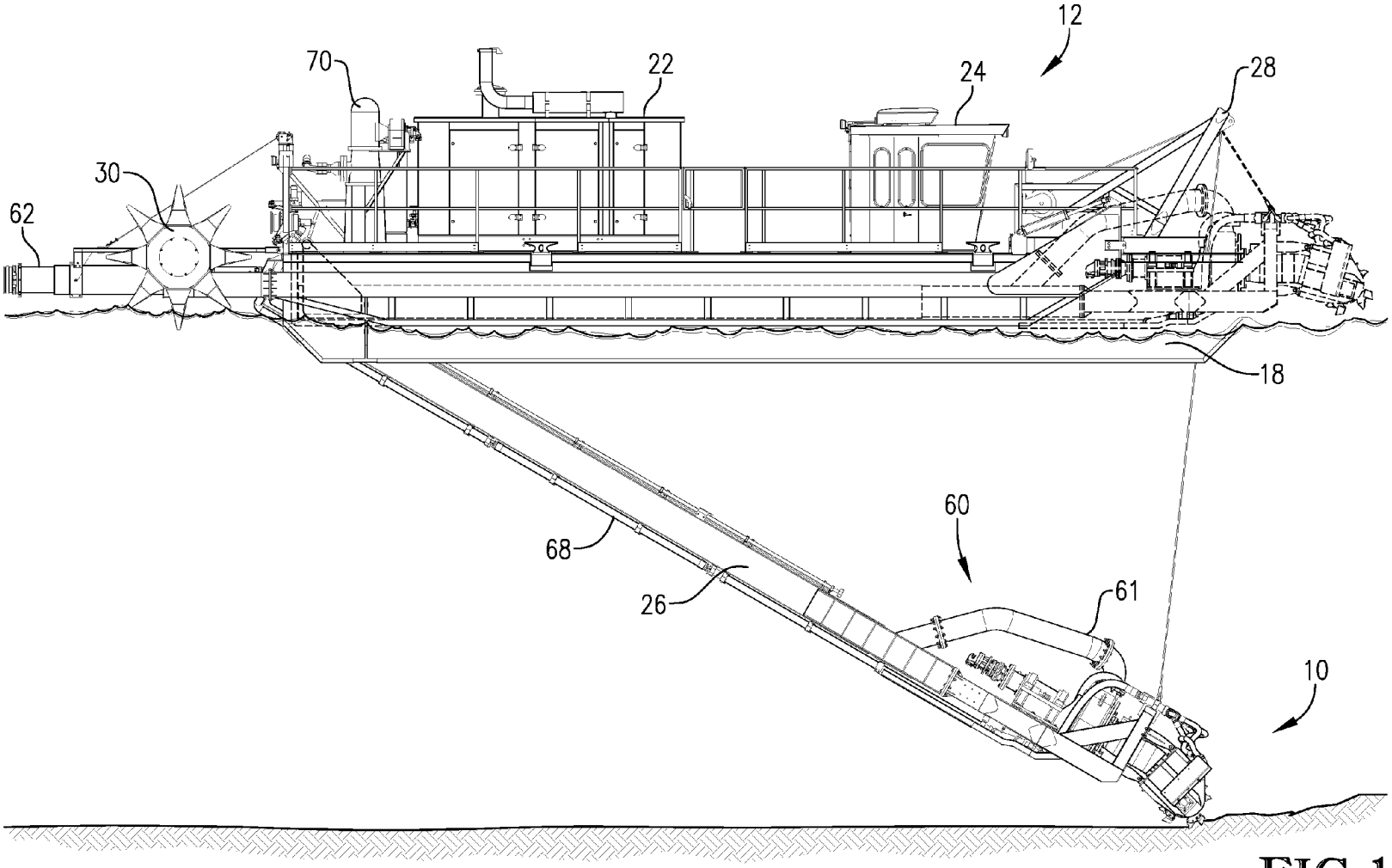
FIG. 1 is side elevation view of a watercraft and a cutterhead of embodiments of the present invention being used for dredging operations, with the cutterhead particularly shown being positioned adjacent to a water-bed of a body of water.

The drawing figures do not limit the present invention to the specific embodiments disclosed and described herein.

The drawings are not necessarily to scale, emphasis instead being placed upon clearly illustrating the principles of the technology.

DETAILED DESCRIPTION

The following detailed description of various embodiments of the present technology references the accompanying drawings which illustrate specific embodiments in which the technology can be practiced. The embodiments are intended to describe aspects of the technology in sufficient detail to enable those skilled in the art to practice them. Other embodiments can be utilized and changes can be made without departing from the scope of the technology. The following detailed description is, therefore, not to be taken in a limiting sense. The scope of the present technology is defined only by the appended claims, along with the full scope of equivalents to which such claims are entitled.

Note that in this description, references to "one embodiment" or "an embodiment" mean that the feature being referred to is included in at least one embodiment of the present invention. Further, separate references to "one embodiment" or "an embodiment" in this description do not necessarily refer to the same embodiment; however, such embodiments are also not mutually exclusive unless so stated, and except as will be readily apparent to those skilled in the art from the description. For example, a feature, structure, act, etc. described in one embodiment may also be included in other embodiments. Thus, the present invention can include a variety of combinations and/or integrations of the embodiments described herein.

Figure 2:
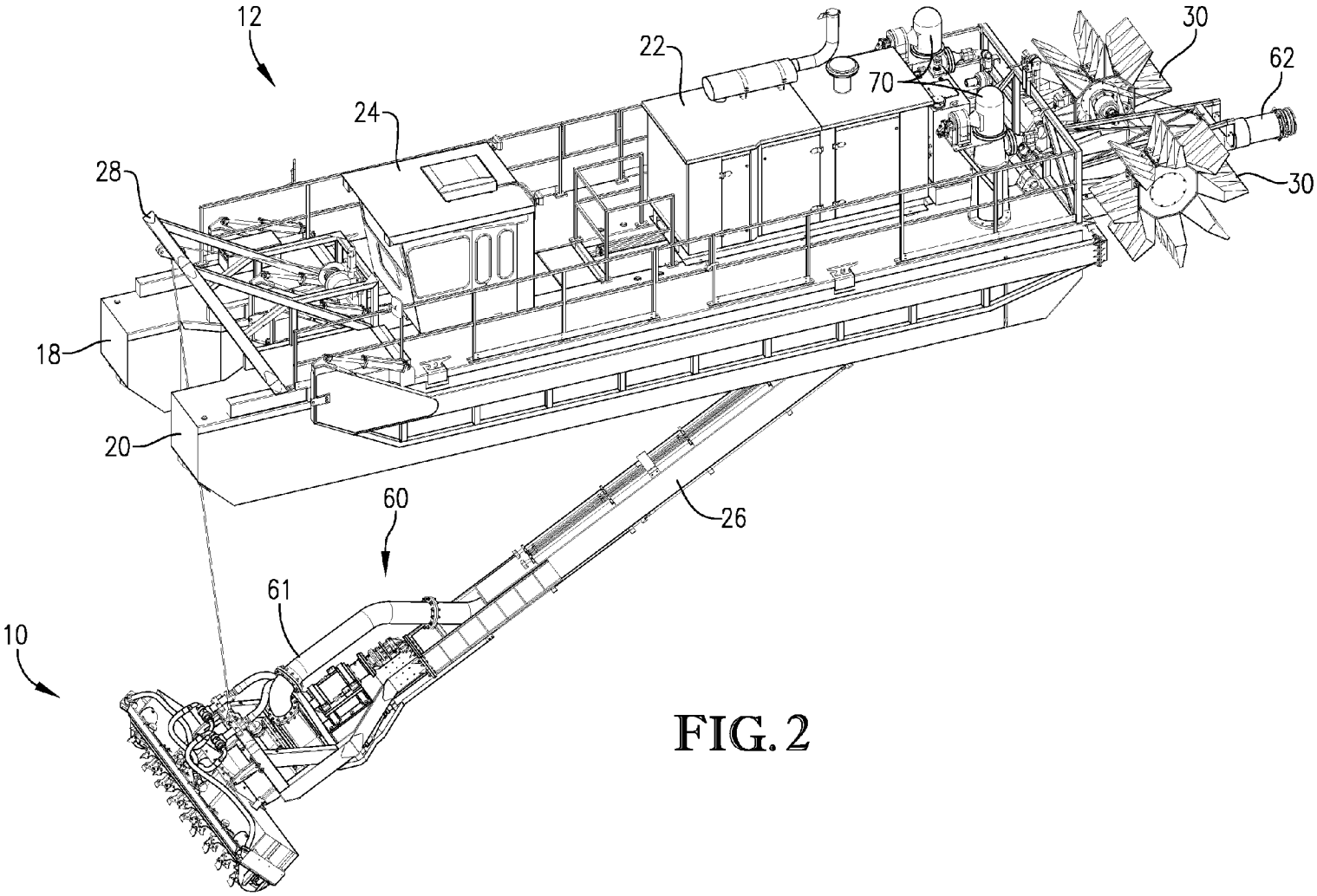
FIG. 2 is a top front isometric view of the watercraft from FIG. 1.

Referring now to the drawings, a water-jet cutterhead 10 in accordance with the present invention may be provided as a part of a watercraft 12 or added to an existing watercraft 12. The cutterhead 10 will be described in more detail below. With reference to FIGS. 1-2, the watercraft 12 may be any conventional type of watercraft, and in some embodiments may be a dredge having a catamaran-type hull configuration with two buoyant pontoons 18 and 20 (only pontoon 18 shown in FIG. 1), an engine compartment 22, a cab 24 where the operator may be located, and a boom 26 for moving the cutterhead 10, with the boom 26 being positioned between the pontoons 18 and 20. The watercraft 12 has certain of the same general components as the watercrafts shown in U.S. Pat. Nos. 5,481,856 and 5,782,660, the entire disclosures of which are incorporated herein by reference.

Remaining with FIGS. 1-2, the boom 26 may be pivotally mounted near a stern of the watercraft 12 and supported near the bow of the watercraft 12 by a hoist 28. As such, a forward end of the boom 26 may be raised and lowered, via lift cables connected to the hoist 28, to an effective height relative to the surface of the water on which the watercraft 12 is supported. As such, because the cutterhead 10 is connected to the boom's 26 forward end, the boom 26 is operable to raise and lower the cutterhead 10 relative to the surface of the water. Generally, the watercraft 12 will be operated in relatively shallow bodies of water, such that the cutterhead 10 can be lowered to a position adjacent to the water-bed of the body of water, as is illustrated in FIG. 1.

The watercraft 12 may be provided with its own propulsion system such as an inboard engine and forced water-jet drive or a screw stern drive, or one or more outboard engines. Alternatively, the watercraft 12 may comprise a watercraft propulsion system as shown in the aforementioned U.S. Pat. No. 5,782,660. For example, as illustrated in FIGS. 1-2, the watercraft 12 may have a paddlewheel-type propulsion system comprising one or more paddlewheels 30. As such, a rotation of the paddlewheels 30 can provide propulsion for the watercraft 12. The paddlewheels 30 may be hydraulically powered, such as by a hydraulic pump that is itself powered by a diesel engine housed in the engine compartment 22. In some embodiments, the diesel engine may comprise a 445 horsepower diesel engine. The propulsion system may also include its own boom and hoist, such that the paddlewheels 30 can be raised and lowered, via lift cables, relative to the surface of the water. As such, the paddlewheels 30 can be used to propel the watercraft 12 as they are positioned on the surface of the water. Alternatively, the paddlewheels 30 can be lowered to a position adjacent to the water-bed, such that the paddlewheels 30 can propel the watercraft 12 by rotating about the surface of the water-bed. In some alternative embodiments, the watercraft 12 may be positioned by the use of a plurality of cables and winches, with the cables anchored to the shore, pilings or the like, whereby the position of the watercraft 12 on the water may be changed by lengthening and shortening the cables.

Figure 3:
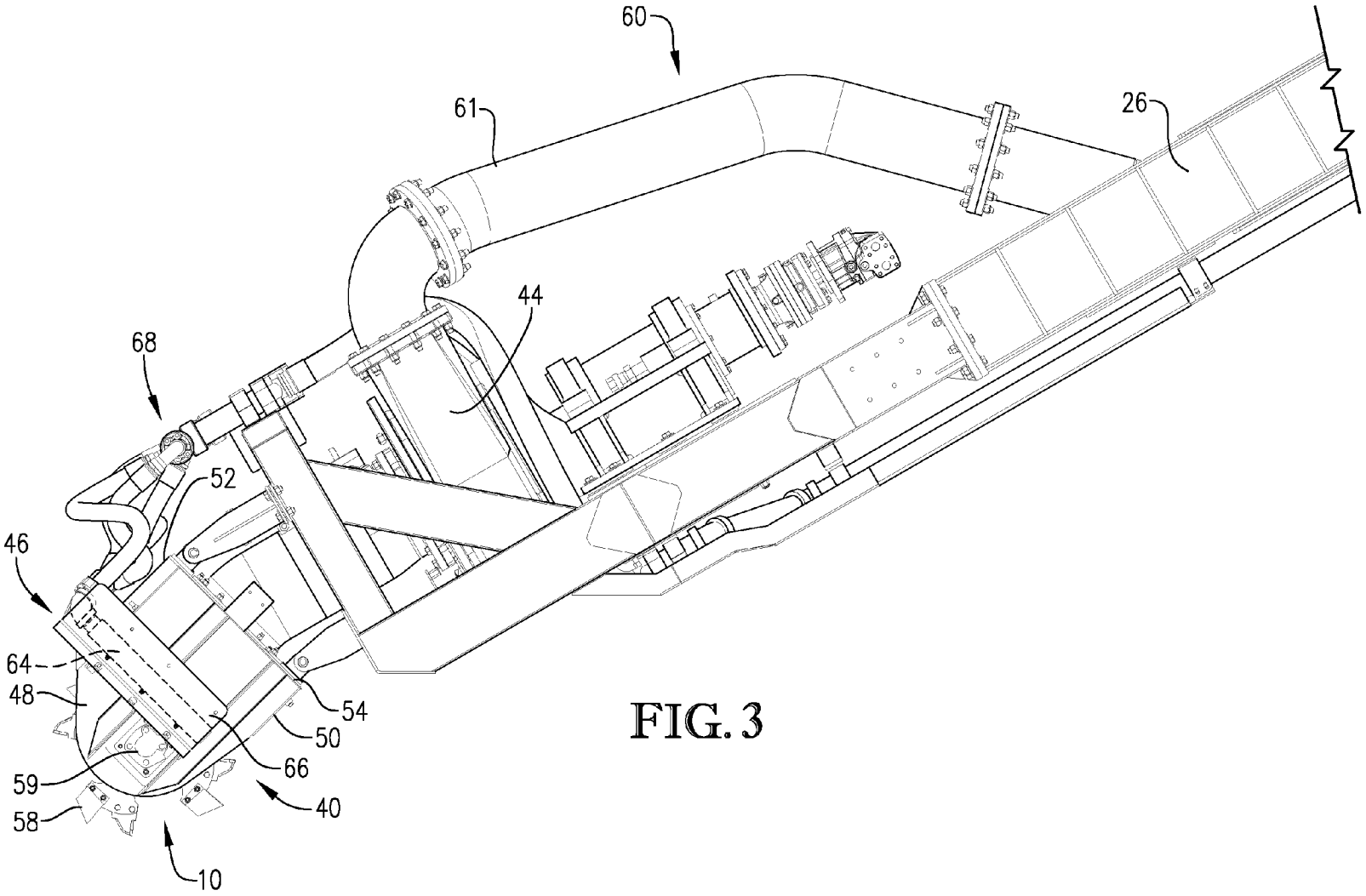
FIG. 3 is a partial side elevation view of the cutterhead from the watercraft of FIGS. 1-2.
Figure 4:
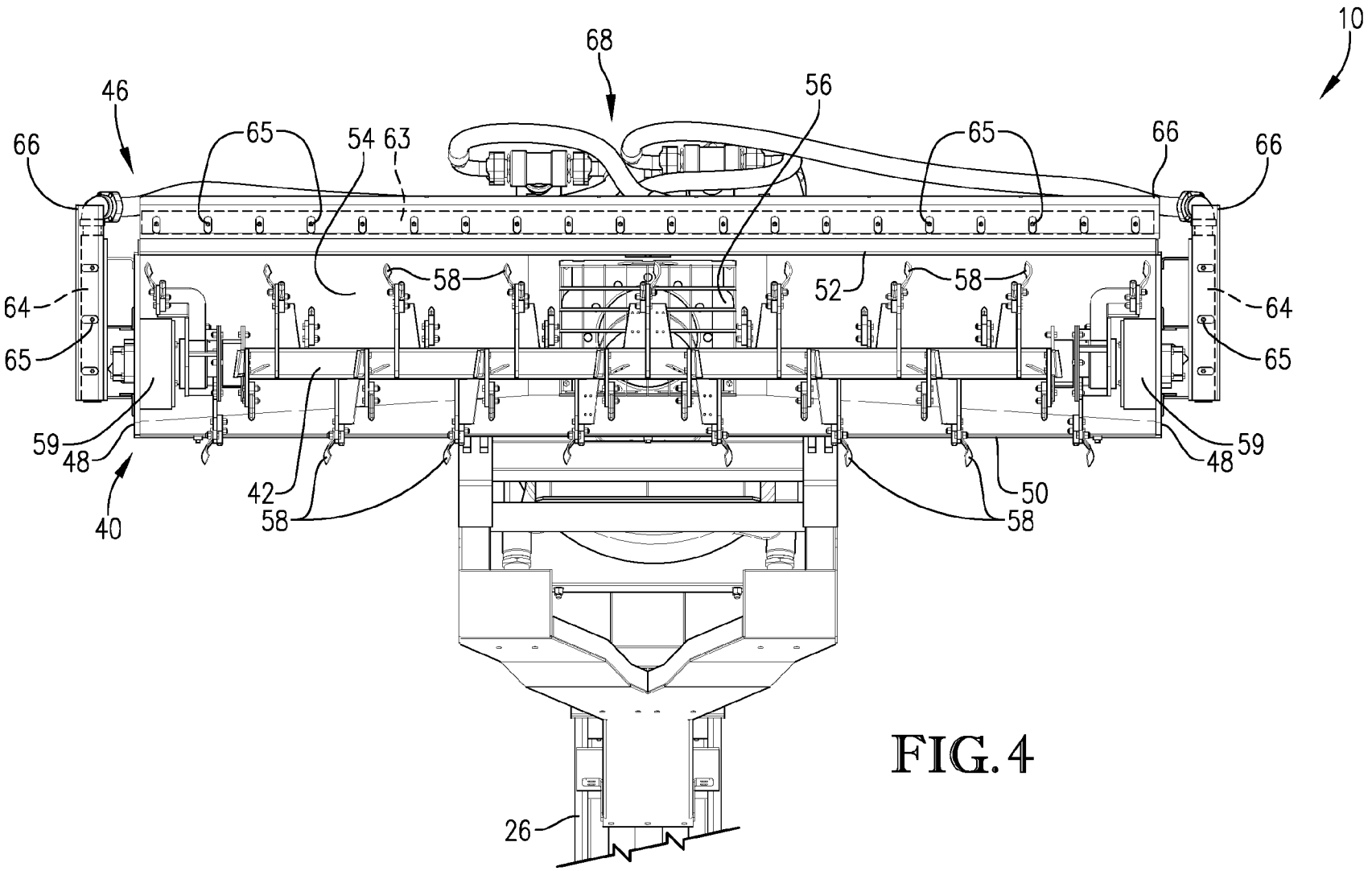
FIG. 4 is a partial bottom front elevation view of the cutterhead from FIG. 3.

With reference to FIGS. 3-4, the cutterhead 10 of embodiments of the present invention broadly includes a shroud 40, a rotatable cutterbar 42 (not shown in FIG. 3), a cutter pump 44 (not shown in FIG. 4), and one or more water-jet bars 46. The shroud 40 may be made of corrosion-resistant material such as stainless steel or other material and provided with a coating that resists corrosion in marine or otherwise harsh environments. The shroud 40 may be essentially funnel-shaped, extending forward of the cutter pump 44, so as to act as a funnel to collect and deliver debris through the shroud 40 and to the cutter pump 44. As such, and as best illustrated in FIG. 4, the shroud 40 may broadly comprise sidewalls 48, a bottom wall 50, a top wall 52, and a backwall 54, with the backwall 54 including a port 56 (See FIG. 4) fluidly connected to the cutter pump 44 (See FIG. 3). The sidewalls 48 extend between the bottom wall 50 and the top wall 52, such that front edges of the sidewalls 48, the bottom wall 50, and the top wall 52 together form a front margin, which presents a large opening to collect water-bed material and deliver the material to the cutter pump 44 through the port 56.

Remaining with FIGS. 3-4, the rotatable cutterbar 42 is rotatably secured within the shroud 40. The cutterbar 42 may include a longitudinal support shaft extending along an axis of rotation of the cutterbar 42. The cutterbar 42 may also include a plurality of blades 58 extending radially from the shaft. The cutterbar 42 may be caused to rotate by one or more motors 59, which may be electrically or hydraulically actuated.

As shown in FIG. 3, the cutter pump 44 is positioned behind the shroud 40, such that an inlet of the cutter pump 44 is fluidly connected with the port 56. The cutter pump 44 may be a centrifugal pump, and most preferably may be a solid waste or a chopper pump. The cutter pump 44 may be driven by an electric motor, hydraulic motor, power take-off, or the like. By way of example, the cutter pump 44 may be a chopper pump, such as sold by Vaughan Co., Inc. of Montesano, Wash., USA and as shown and described in U.S. Pat. Nos. 3,973,866, 4,840,384, 4,842,479, 5,076,757, 5,456,580, 5,460,482, 5,460,483, 7,125,221, 7,841,550 and 8,105,017, the entire disclosures of which are incorporated herein by reference. With reference to FIGS. 1-2, a discharge pipe 60 is fluidly connected at a first end 61 to an outlet side of the cutter pump 44 and extends up along the boom 26 to a second end 62 positioned aft of the pontoons 18, 20 of the watercraft 12. The discharge pipe 60 may have a diameter of about eight inches or more.

Given the description of the cutterhead 10 provided above, the cutterhead 10 may be lowered to a position adjacent to the water-bed of a body of water (as shown in FIG. 1, such that the cutterbar 42 of the cutterhead 10 can rotate and grind into the water-bed material. As such, the cutterhead 10 can fluidized the water-bed material into the surrounding liquid of the body of water, thereby forming a slurry mixture of water and water-bed material. Thereafter, the cutter pump 44 is configured to draw the slurry mixture into the shroud 40, through the cutter pump 44, through the discharge pipe 60, and out the second end 62 of the discharge pipe 60. To remove the water-bed material from the body of water, a relatively large diameter hose or conduit (not shown) may be attached to the second end 62 of the discharge pipe 60. Such hose or conduit may be used to convey the slurry mixture to a remote collection site, such as a barge or an adjacent shore station, where the water-bed material from the slurry mixture can be collected for further use or for disposal.

Because certain water-bed materials are hard or compact (e.g., compacted sand, clay, silt, and/or other sediments), the fluidizing power of the rotating cutterbar 42 may be insufficient to properly fluidizing the water-bed material for removal by the cutterhead 10. As such, embodiments of the present invention include the one or more water-jet bars 46 for enhancing the fluidization of the water-bed material. In more detail, and with reference to FIGS. 3 and 4, the one or more water-jet bars 46 of the cutterhead 10 may be in the form of a fluid manifold and may include a top water-jet bar 63 (not shown in FIG. 3) secured to the top wall 52 of the shroud 40 at a position adjacent to the shroud's 40 front margin. The water-jet bars 46 may also include side water-jet bars 64 secured to each of the sidewalls 48 of the shroud 40 at a position adjacent to the shroud's 40 front margin. As best illustrated in FIG. 4, the side water-jet bars 64 may be orientated generally parallel with each other and generally perpendicularly with the top water-jet bar 63. Each of the water-jet bars 46 may include a plurality of water-jet nozzles 65 configured to emit a high-pressure stream of liquid. For instance, the top water-jet bar 63 may comprise between 10 and 30 nozzles, between 15 and 25 nozzles, or about 20 water-jet nozzles 65. Each of the side water-jet bars 64 may include between 1 to 8, between 2 to 6, or about 3 water-jet nozzles 65. Each of the water-jet nozzles 65 may be independently adjustable so as to specifically configure the direction at which the water-jet nozzle 65 is pointed. Each of the water-jet bars 46 may include a shield 66 positioned forward of the water-jet nozzles 65. The shields 66 may be formed from a high-strength material, such as stainless steel, composite materials, or the like. The shields 66 may include a plurality of apertures that align with each of the water-jet nozzles 65 of the water-jet bars 46.

The water-jet bars 46 are fluidly connected to a water hose 68, or a system of water hoses 68, which extend from the cutterhead 10 up the boom 26 and connect to one or more high-pressure liquid pumps 70 (See FIGS. 1-2) positioned adjacent to and/or integrated within the pontoons 18, 20 of the watercraft 12. The liquid pumps 70 may extend from adjacent the pontoons 18, 20 at least partially below the surface of the water, such that the liquid pumps 70 can access and pump water from near the surface down the water hoses 68 and to the water-jet bars 46. The liquid pumps 70 may be driven by an electric motor, hydraulic motor, power take-off, or the like. In some embodiments, the liquid pumps 70 will have a total power output of between about 50 to 200, between 75 and 150, or about 100 horsepower so as to provide sufficient pressure for the water-jet bars 46 to emit water with enough force to fluidize the water-bed material. For instance, the liquid pumps 70 may be configured to output at least 250, at least 500, or at least 750 gallons of water per minute. In some embodiments, as shown in the figures, the cutterhead 10 will be associated with two liquid pumps 70, such that each liquid pump 70 may be rated at about one-half the required power output (e.g., each liquid pump 70 may be rated at about 50 horsepower to achieve the required power output of about 100 horsepower). As such, the liquid pumps 70 may provide for each of the water-jet nozzles 65 of the water-jet bars 46 to have an output of between 10 and 30, between 15 and 25, or about 19.5 gallons of water per minute at pressures of between about 150 and 350, between about 200 and 300, or about 250 pounds per square inch.

To perform dredging operations, and returning to FIG. 1, the watercraft 12 is preferably placed in a shallow body of water having regions of limited depth whereby the boom 26 may be lowered to a depth sufficient for the cutterhead 10 to come into engagement with the water-bed. To lower the boom 26, an operator of the watercraft 12 may actuate a boom control mechanism, such as a switch, lever, crank, or the like, which actuates the lift cables attached to the hoist 28. The boom control mechanism may be electrically, mechanically, hydraulically, or pneumatically configured. Once the cutterhead 10 is in position adjacent to the water-bed, the operator can activate the rotatable cutterbar 42 by actuating a cutterbar control mechanism, such as a switch, lever, crank or other similar mechanism. As with the boom control mechanism, the cutterbar control mechanism may be electrically, mechanically, hydraulically, or pneumatically configured. Once activated, the rotatable cutterbar 42 is rotated by the motors 59 and begins grinding into the water-bed so as to fluidize the water-bed material into the surrounding water to create a slurry. Simultaneously, or a short time thereafter, the operator can activate the cutter pump 44 by actuating a cutter pump control mechanism, such as a switch, lever, crank, or other similar mechanism. The cutter pump control mechanism may be electrically, mechanically, hydraulically, or pneumatically configured. As such, the cutter pump 44 can begin to pump the slurry (i.e., the water-bed material fluidized in the surrounding water) away from the water-bed, through the discharge pipe 60, and to a remote collection site.

As was previously described, in some instances, the water-bed material may be hard and/or overly compacted, such that the rotating cutterbar 42 lacks sufficient power to satisfactorily fluidize the water-bed material for removal via the cutter pump 44. In such instances, embodiments of the present invention provide for the operator of the watercraft to activate the water-jet bars 46 on the shroud 40 of the cutterhead 10 by actuating a water-jet control mechanism, such as a switch, lever, or other similar mechanism. The water-jet control mechanism may be electrically, mechanically, hydraulically, or pneumatically configured. As such, the liquid pumps 70 will be activated so as to withdraw water from near the surface of the body of water and force the water through the water hose(s) 68 and out the water-jet nozzles 65 of the water-jet bars 46. Because the water-jet nozzles 65 are directed at the portion of the water-bed that is currently being dredged, the water-jet nozzles 65 will provide excavation assistance by impacting the water-bed material with high-pressure jets of water emitted from the water-jet nozzles 65. The impact of such high-pressure jets of water on the water-bed act to efficiently fluidize the water-bed material into a slurry.

Beneficially, the side water-jet bars 64 provide for the cutterhead 10 to emit more water and to fluidize more water-bed material than a cutterhead that only includes a single water jet bar 46, such as only a top water-jet bar 63. As such, more water-bed material can be fluidized (i.e., put into suspension within the surrounding water to form a slurry), such that the cutter pump 44 can increase the production volume of the slurry that can be pumped away from the water-bed to a remote collection site. Specifically, the water-jet bars 46 of the present invention allow water-bed material to be put into suspension in front of the cutterhead 10 at a faster rate, such that the cutter pump 44 can remove the material from the body of water at a correspondingly faster rate.

Furthermore, the shields 66 of the water-jet bars 46 allow the high-pressure jets of water to pass, via the apertures in the shields 66, while at least partially protecting the water-jet nozzles 65 from material impacts from particulates in the slurry. In particular, as the water-jet bars 46 emit the high-pressure jets of water and fluidize the water-bed material into a slurry, the shields 66 at least partially prevent particles of the water-bed material fluidized in the slurry from impacting the water-jet nozzles 65 and damaging such nozzles 65.

Furthermore, the water-jet bars 46 beneficially provide the ability to pave a path into the water-bed through which the cutterhead 10 will travel. Specifically, the side water-jet bars 64 provide the ability to fluidize water-bed material just to the lateral sides of the shroud 40 of the cutterhead 10. As such, the path through the water-bed created by the cutterhead 10 of embodiments of the present invention can be made wider than a path that may be created using a cutterhead with only a top water-jet bar 63. A wider path through the water-bed may be beneficial because it will allow the cutterhead 10 to move with less frictional contact through the water-bed. Specifically, the cutterhead can travel generally unimpeded along path without the walls of the shroud 40 (i.e., sidewalls 48, bottom wall 50, and top wall 52) making significant contact with (i.e., being dragged through) the water-bed. In addition, the ability of the side water-jet bars 64 to assist in fluidizing water-bed material may allow the cutterhead 10 to be positioned deeper within the path that is carved through the water-bed. By positioning the cutterhead 10 deeper within the water-bed, water-bed material can be fluidized and removed at a faster rate. Furthermore, the top water-jet bar 63 can be positioned closer to the water-bed so as to further enhance the ability to fluidize the water-bed material and to remove such fluidized water-bed material from the body of water.

Figure 5:
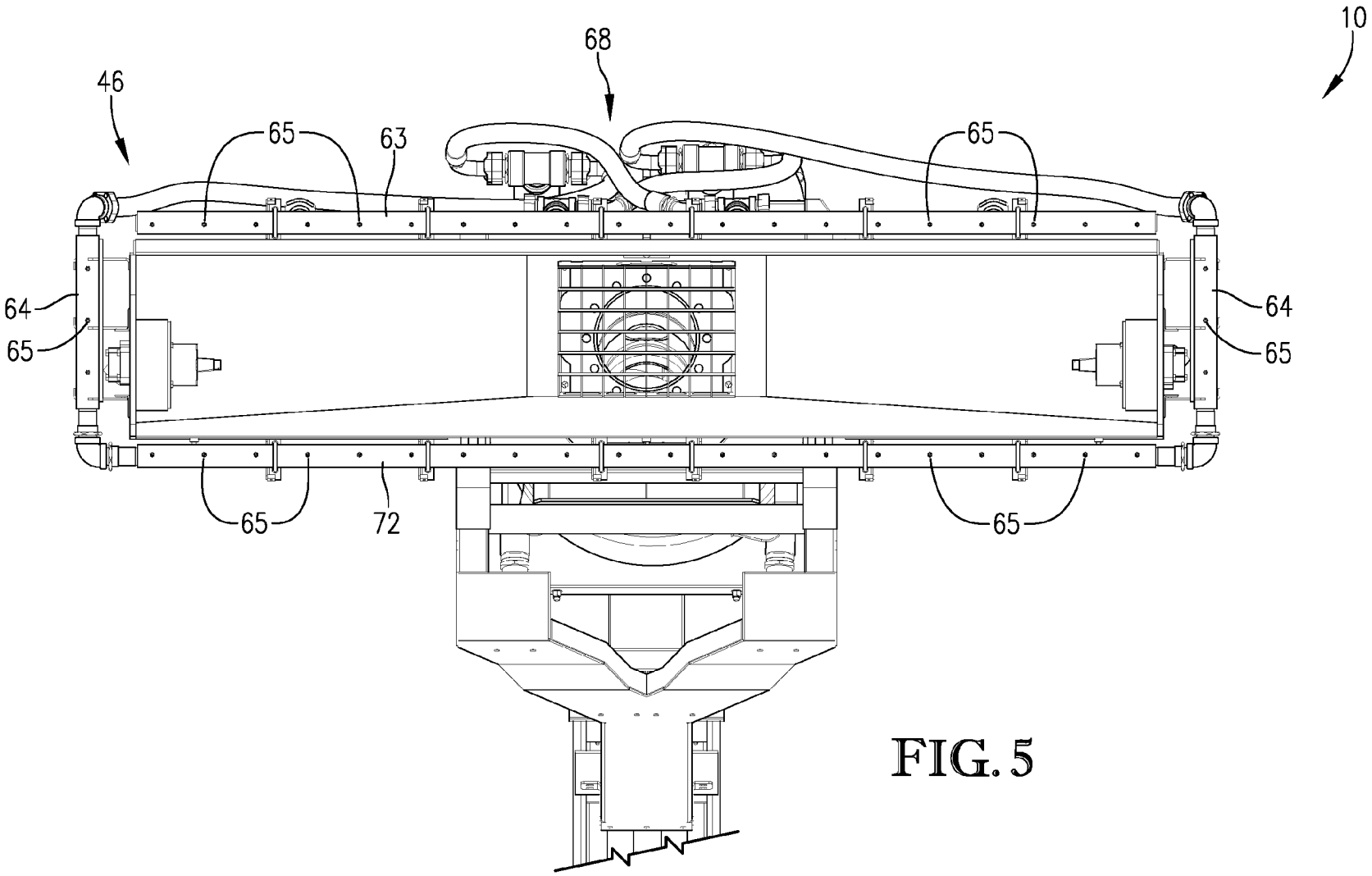
FIG. 5 is a partial bottom front elevation view of a cutterhead according to embodiments of the present invention, particularly illustrating the cutterhead including four water-jet bars positioned about a shroud of the cutterhead.

In addition to the dredging operations described above, the cutterhead 10 of embodiments of the present invention may, alternatively, be used to perform injection dredging-type operations. Injection dredging may be performed by fluidizing water-bed material, and allowing natural underwater currents of the body of water to remove the material. Such injection dredging operations may be further facilitated if the water-bed material to be removed is located at a relatively higher elevation than surrounding portions of the water-bed. In such instances, once the water-bed material is fluidized, gravity will assist in transporting the water-bed material and removing it away from its initial location. To perform such injection dredging operations, as illustrated by FIG. 5, the rotatable cutterbar 42 may be removed from the cutterhead 10, such that only the water-jet bars 46 are available to fluidize the water-bed material. As such, the cutterhead 10 can be positioned adjacent to the water-bed, as was previously described, and the water-jet nozzles 65 of the water-jet bars 46 can be activated to fluidize the water-bed material.

Upon fluidizing the water-bed material, the natural currents and/or gravity can facilitate removal of the water-bed material that has been fluidized in the surrounding water. In some embodiments, such as illustrated in FIG. 5, the cutterhead 10 may also include a bottom water-jet bar 72, which is attached to the bottom wall 50 of the shroud 40. As illustrated in FIG. 5, the bottom water-jet bar 72 may be orientated generally parallel with the top water-jet bar 63. As with the top water-jet bar 63, the bottom water-jet bar 72 may include between 10 to 30, between 15 to 25, or about 20 water-jet nozzles 65. Each of such nozzles 65 may be fluidly connected to the water hose 68 and to the higher-pressure liquid pumps 70, such that the nozzles 65 can emit high-pressure jets of water at the water-bed to assist with the fluidization of the water-bed material. Because the cutterhead 10 includes water-jet bars 46 on each of its walls, the ability of the cutterhead 10 to fluidize water-bed material is significantly increased. It should be understood that although FIG. 5 illustrates the water-jet bars 46 not having the rotatable cutterbar 42 or the shields 66, embodiments of the present invention also contemplate that such injection dredging operations may be performed with the rotatable cutterbar 42 or shields 66 in place to assist with fluidization of the water-bed material and to help protect the water-jet nozzles 65 from damage, respectively.

Although the invention has been described with reference to the preferred embodiment illustrated in the attached drawing figures, it is noted that equivalents may be employed and substitutions made herein without departing from the scope of the invention as recited in the claims. For instance, it should be understood that when the cutterhead 10 is being used to dredge light water-bed material that does not require the use of the water-jet bars 46 to enhance fluidization of the water-bed material, the water-jet bars 46 may be deactivated such that the cutterbar 42 of the cutterhead 10 provides all required fluidization of the water-bed material.

What is claimed is:

1. A cutterhead for dredging a water-bed of a body of water, the cutterhead comprising:

a shroud including a top wall, a bottom wall, and two sidewalls each extending between the top and bottom walls;

a rotatable cutterbar at least partially received within an interior space presented by the shroud;

a first water-jet bar extending along a portion of the top wall of the shroud;

a second water-jet bar extending along at least a portion of one of the two sidewall; and a third water-jet bar extending along at least a portion of another of the two sidewalls, wherein each of the first water-jet bar, the second water-jet bar, and the third water-jet bar comprises a plurality of water-jet nozzles for emitting high-pressure jets of water, wherein the cutterbar and the water-jet bars are configured to generate a slurry of fluidized material from the water-bed, wherein each of the first water-jet bar, the second water-jet bar, and the third water-jet bar includes a shield positioned forward of its respective water-jet bar for protecting the water-jet nozzles, wherein said shields are each formed with a plurality of apertures, with such apertures being aligned with the water-jet nozzles of the water-jet bars so as to permit high-pressure jets of water to pass from the water-jet bars through the shields to generate the slurry of fluidized material from the water-bed.

2. The cutterhead of claim 1, further comprising a cutter pump including an inlet fluidly connected to the interior space of the shroud, wherein the cutter pump is configured to draw the fluidized material in through the shroud and into the cutter pump.

3. The cutterhead of claim 2, wherein the cutter pump further includes an outlet fluidly connected to a discharge pipe, wherein the discharge pipe is configured to direct the slurry to a remote collection site.

4. The cutterhead of claim 1, wherein the water-jet bars are fluidly connected to a high-pressure pump, and wherein the high pressure pump is configured to provide for each of the water-jet nozzles to emit a jet of water at a pressure of at least 250 pounds per square inch.

5. The cutterhead of claim 1, wherein the first and second water-jet bars are generally perpendicular to each other.

6. The cutterhead of claim 5, wherein the third water-jet bar is generally parallel with the second water-jet bar.

7. The cutterhead of claim 6, further comprising a fourth water-jet bar extending along at least a portion of the bottom wall of the shroud, wherein the fourth water-jet bar is generally parallel with the first water-jet bar.

8. The cutterhead of claim 1, wherein the first water-jet bar includes at least twenty water jet nozzles, and wherein the second water-jet bar includes at least three water jet nozzles.

9. The cutterhead of claim 1, wherein the cutterbar comprises a longitudinal support shaft and a plurality of blades extending from the support shaft.

10. A dredge-type watercraft for dredging a water-bed of a body of water, said watercraft comprising:

a hull;

a boom having first and second ends, with the first end being pivotably secured to the hull; and a cutterhead secured to the second end of the boom, with the cutterhead including— a shroud including a top wall, a bottom wall, and two sidewalls each extending between the top and bottom walls, a rotatable cutterbar at least partially received within an interior space presented by the shroud, a first water-jet bar extending along a portion of the top wall of the shroud, and a second water-jet bar extending along at least a portion of one of the two sidewalls, wherein each of the first water-jet bar and the second water-jet bar comprises a plurality of water-jet nozzles for emitting high-pressure jets of water for generating a slurry of fluidized material from the water-bed, wherein each of the first water-jet bar and the second water-jet bar includes a shield positioned forward of its respective water-jet bar for protecting the water-jet nozzles, wherein said shields are each formed with a plurality of apertures, with such apertures being aligned with the water-jet nozzles of the water-jet bars so as to permit high-pressure jets of water to pass from the water-jet bars through the shields.

11. The watercraft of claim 10, further comprising a cutter pump including an inlet fluidly connected to the interior space of the shroud, wherein the cutter pump is configured to draw the fluidized material in through the shroud and into the cutter pump.

12. The watercraft of claim 11, wherein the cutter pump further includes an outlet fluidly connected to a discharge pipe, wherein the discharge pipe extends from the cutterhead, up along the boom, and to a position adjacent to the hull of the watercraft.

13. The watercraft of claim 10, wherein the watercraft further includes a hoist operable to raise and lower the boom, and wherein the hoist is configured to lower the boom such that the cutterhead is positioned adjacent to the water-bed of the body of water on which the watercraft is configured to operate.

14. The watercraft of claim 10, wherein the water craft includes one or more water-jet pumps positioned adjacent to the hull of the watercraft, wherein the water-jet pumps are fluidly connected to the water-jet bars via fluid lines extending along the boom.

15. The watercraft of claim 14, wherein the water-jet pumps are configured to provide water to the water-jet bars such that each of the water-jet nozzles will output at least 19 gallons of water per minute.

16. A method for dredging material from a water-bed, the method comprising the following steps:

(a) lowering a boom from a watercraft, wherein the boom includes a cutterhead attached thereto for fluidizing the material from the water-bed, wherein the cutterhead includes a shroud comprising a top wall, a bottom wall, and two sidewalls each extending between the top and bottom walls, wherein the cutterhead additionally includes water-jet nozzles extending along at least a portion of each of the top wall and the two sidewalls, and wherein the cutterhead further includes shields positioned in front of each of the water-jet nozzles for protecting the water-jet nozzles, wherein said shields are formed with a plurality of apertures, with such apertures being aligned with the water-jet nozzles so as to permit high-pressure jets of water to pass from the water-jet nozzles through the shields;

wherein during the lowering of step (a), the boom is lowered such that the cutterhead is positioned adjacent to the water-bed;

(b) causing the water-jet nozzles to emit high-pressure jets of water so as to fluidize material from the water-bed; and (c) removing the fluidized material from near the water-bed and to a remote collecting location.

17. The method of claim 16, further comprising the step of causing a cutterbar associated with the cutterhead to rotate so as to further fluidize material from the water-bed.

* * * * *